US005627632A

United States Patent [19]

Staudenmayer et al.

[11] Patent Number: 5,627,632

[45] Date of Patent: May 6, 1997

[54] ELECTROSTATOGRAPHIC APPARATUS HAVING A TONER TRANSFER ASSISTANCE SYSTEM AND PROCESS

[75] Inventors: William J. Staudenmayer, Pittsford; Douglas E. Bugner, Rochester, both of N.Y.

[73] Assignee: Eastman Kodak Company, Rochester, N.Y.

[21] Appl. No.: 613,648

[22] Filed: Mar. 11, 1996

[51] Int. Cl.[6] ..... G03G 15/14

[52] U.S. Cl. ..... 399/296; 399/297

[58] Field of Search ..... 355/271–273; 118/DIG. 1

[56] References Cited

U.S. PATENT DOCUMENTS 4,825,227 4/1989 Fischbeck et al. ..... 346/1.1

5,124,716 6/1992 Roy et al. ..... 346/1.1

5,434,657 7/1995 Berkes et al. ..... 355/273

5,510,886 4/1996 Sugimoto et al. ..... 355/273

*Primary Examiner*—Matthew S. Smith

*Attorney, Agent, or Firm*—Leonard W. Treash, Jr.

[57] ABSTRACT

A system for assisting the transfer of a toner image formed by electrostatographic apparatus and process to a copy sheet. The transfer assistance system and process utilize drop generators to form a release liquid pattern for joining with such toner image and a supply mechanism delivers release material, e.g., heat wax material, to the drop generators. In a preferred mode release liquid is applied, in a patterns customized to toner patterns, to an intermediate transfer member.

20 Claims, 3 Drawing Sheets

ELECTROSTATOGRAPHIC APPARATUS HAVING A TONER TRANSFER ASSISTANCE SYSTEM AND PROCESS

FIELD OF THE INVENTION

The present invention relates to electrostatographic apparatus and more particularly to improved structures and methods for transferring image patterns of toner during the operations of such apparatus.

BACKGROUND OF INVENTION

In electrostatographic apparatus, such as electrophotographic copiers and printers, an electrostatic image pattern is formed by uniformly charging and imagewise exposing a photoconductor member. The latent electrostatic image is then developed by supplying charged toner particles that can be attracted to the photoconductor member to form a corresponding, or opposite sense, toner image. The toner image is then transferred to a copy sheet, or to an intermediate transfer member that subsequently re-transfers it to a copy sheet. The transfer from the photoconductor is most often effected by use of electrical potentials that cause the charged toner particles to move away from the photoconductor. The re-transfers from the intermediate transfer member can be effected by electrical potentials, by heating the toner particles to a tacky state and pressing them into binding contact with the copy sheet fibers or by a combination of those processes.

In each of the transfer processes, it is very desirable that substantially all of the toner comprising the image pattern be transferred. Complete transfer enhances the apparatus performance from two general view points, viz: (I) no residual toner remains on the photoconductor or intermediate transfer member to impede or degrade subsequent image operations and (ii) the complete toner pattern ends up at the desired site, so that copies with proper density and/or color balance are attained. However, complete transfers are difficult to achieve, particularly for minimum density image regions and with regard to very small particle toners such as used in high resolution multicolor images.

To improve completeness of transfer, prior art apparatus have provided special release surfaces on intermediate transfer members and applied release liquids to those members, using wicks or brushes (see, e.g., U.S. Pat. No. 5,434,657). On photoconductor members, clear toner with desirable release characteristics has been applied, e.g. with magnetic brush applicators, as an underlayer for the toner image particles. Such prior art techniques are useful but have disadvantages. For example, the wick and brush release liquid applicators are not imagewise selective and can be contaminated and/or wear out the surfaces that they contact. Using underlayers of clear toner particles can increase the final image thicknesses considerably in instances where 3 or 4 different image layers, each with an accompanying underlayer, are superimposed.

SUMMARY OF INVENTION

One important purpose of the present invention is to provide improved devices and methods for effecting more complete transfer of toner images in electrostatographic apparatus. The present invention provides significant advantages by enabling the non-contact application of thin coatings of release liquid in a predetermined pattern(s) that are selectable to enhance transfer for a particular image pattern (s). Thus, the present invention does not suffer the disadvantages of wear and contamination inherent to contact application. Moreover, the present invention avoids thick multiple layer toner stacks produced by clear toner release underlayers. Also, the present invention provides for more intermediated member efficient application of release liquids, e.g. from the viewpoint of reducing the amounts applied and maximizing the application to particular regions where it is needed. The release liquid can be applied in imagewise patterns or other patterns customized to the copy size or other copy characteristics.

In one aspect the present invention constitutes a system for assisting toner image transfer in electrostatographic apparatus of the kind having means for forming a latent electrostatic image on a support member, means for developing such latent image with charged toner particles to form a toner image on the support member and means for transferring the toner image to a copy sheet. The transfer assist system includes drop generator means for controllably directing a plurality of drops of release liquid to form a release liquid pattern for joining with such toner image and supply means for delivering; such release liquid to the drop generator means. In a particularly useful and preferred aspect, release liquid is applied to an intermediate transfer member movable along a path between an imaging member and the copy sheet.

In another aspect the present invention constitutes an improved transfer method for processes of producing electrostatographic copies that comprise forming a toner image electrostatically attracted to a support member and transferring such image to a copy sheet. In accord with the invention, the transfer method includes forming on such support member, a pattern of release liquid drops that is predeterminedly adapted to such toner image.

DESCRIPTION OF DRAWINGS

The subsequent detailed description of the invention refers to the accompanying drawings wherein.

DETAILED DESCRIPTION OF THE INVENTION

Figure 1:
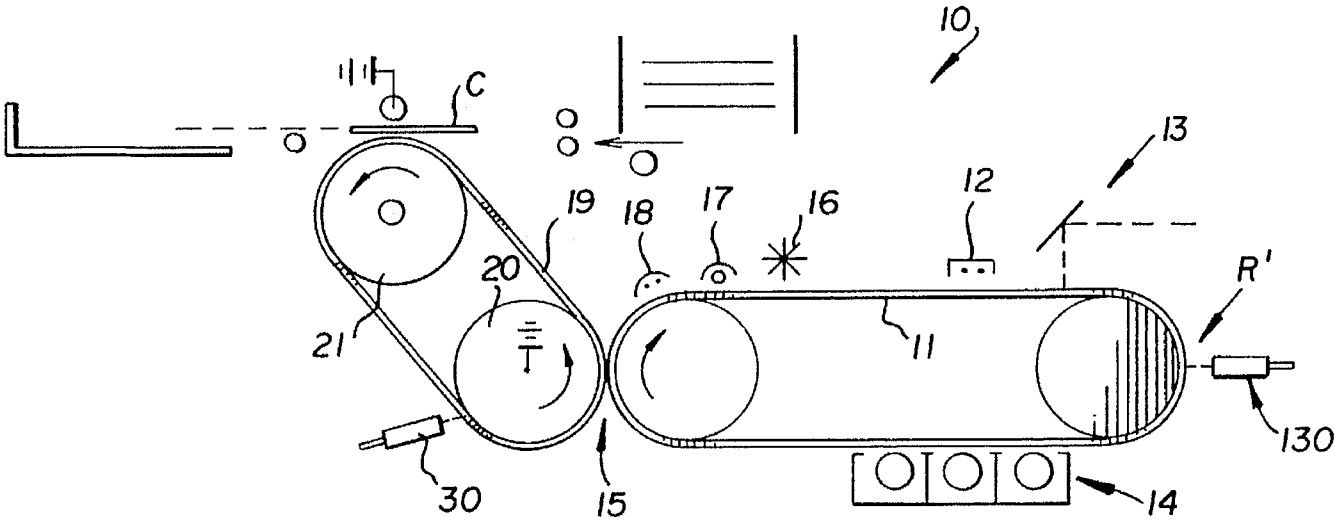
FIGS. 1 and 2 are schematic illustrations of alternative electrostatographic apparatus incorporating transfer assist embodiments in accord with the present invention.

Referring to FIG. 1, the electrostatographic apparatus 10 comprises an endless photoconductor support member 11 that is movable around an operative path past a primary charger 12, an exposure station 13, a development station 14, a first transfer region 15 and a regeneration region, including cleaning brush 16 and erase illumination and corona devices 17, 18. In operation a uniform charge from charger 12 is imagewise discharged by station 13 to form a latent electrostatic image, which is then developed by station 14 to form a toner image comprising toner particles attracted to the charge on the photoconductor. At region 15, the toner image is transferred to an intermediate transfer member 19 by electrical attraction, e.g. bias applied to back up roller 20. The toner image is thereafter transferred to a copy sheet C, e.g. by an electrical field applied between rollers 21, or successive, different color toner image cart be transferred onto member 19 in register before a combined transfer of those images to sheet C is effected.

In either of the above modes, the transfer assist assembly 30, in accord with the present invention, provides a pattern of release oil that is adapted to join to the toner image transferred from photoconductor 11 to intermediate transfer member 19. Assembly 30 in this preferred embodiment is located upstream of the transfer region and (see FIG. 3 ) comprises drop generator means 31, for controllably directing a plurality of drops of release liquid onto the surface of intermediate transfer member 19 in a proper timed relation (with respect to the movements of member 19 and photoconductor 11) such that the release liquid pattern is in register to form a joining interface between the toner image and the surface of member 19. In accord with particular embodiments of the invention, the release liquid pattern applied by assembly 30 can be predeterminedly configured to conform to different aspects of the toner image, e.g. to its general width and/or length, to its general content (such as in regard to high and low density regions, text, half tone or continuous tone). In embodiments where exposure at station 13 is in accord with electronic data, the applied release liquid pattern can conform to general or specific bit map data corresponding to the individual image exposed.

On preferred drop generator construction for providing capabilities for such pattern application of release liquid drops comprises, in general, an array of piezoelectric drop on demand devices 32 (shower in more detail in FIG. 4), a supply manifold 33 for providing the devices 32 with release liquid, an indexing assembly 34 for positioning the devices 32 transversely with respect to an application region R, which extends across the path of movement of transfer member 19, upstream of the transfer region 15. A control system 50 (shown in FIG. 5) controls the movement of devices 32 and their drop-on-demand actuations in proper timed relation with movement of member 19 to form the predetermined patterns of liquid drops that are adapted for particular toner image configurations and content.

Figure 4:
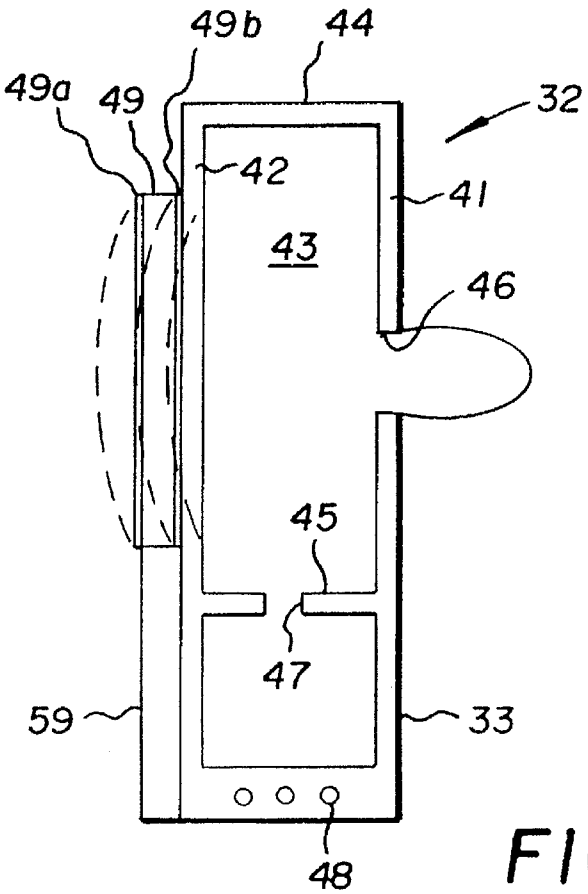
FIG. 4 is an enlarged cross-sectional schematic illustration of portions of the assembly shown in FIG. 3.

Each of devices 32 is capable of controllably directing individual drops of release liquid to predetermined locations along application region R, and as shown in FIG. 4, comprise front and rear walls 41, 42, side walls 43 and top and bottom walls 44, 45 which define a liquid chamber having a drop outlet orifice 46 and release liquid refill inlet 47. The supply manifold 33 couples to the bottom of the drop generator and can have heater elements 48 in a wall to maintain desired temperatures and (thus viscosity) for liquids supplied through inlets 47 of the generators. The rear wall 42 has a section which is bendable in response to the change in length of a thin piezoelectric element 49 that is attached to its exterior side; however, the rear wall can be formed of piezoelectric material itself (see U.S. Pat. No. 4,825,227) or a rear wall pusher of piezoelectric material can be utilized (see U.S. Pat. No. 5,124,716). In each embodiment the piezoelectric element is actuated by applying a drive voltage, across a section of the element. In the FIG. 4 embodiment, surface electrodes 49*a*, 49*b* are selectively coupled to a high voltage source 90 under the control of a circuit chip, such as a serial in parallel out shift register 59. The on or off voltage across the electrodes causes the element 49 to expand and contract and displace the rear wall 42 first away from the liquid chamber (as indicated in dotted lines in FIG. 4) and then back toward the chamber (to the solid line position). The increase in volume of an actuated generator induces liquid to flow into the chambers through passage 47, and the chambers contraction, upon termination of the actuating voltage, ejects a drop D of release liquid through orifice 46 and on a flight path toward a site within application region R. This "fill-before-fire" mode is useful to allow actuations in the 10 to 20 microsecond range. Where less rapid ejection rates are required capillary refill can be used and the voltage pulse can actuate immediate ejection. In certain applications of the present invention, thermal drop-on-demand generators and continuous drop generators such as used in ink jet printers can be utilized; however, piezoelectric drop-on-demand generators are preferred.

Figure 3:
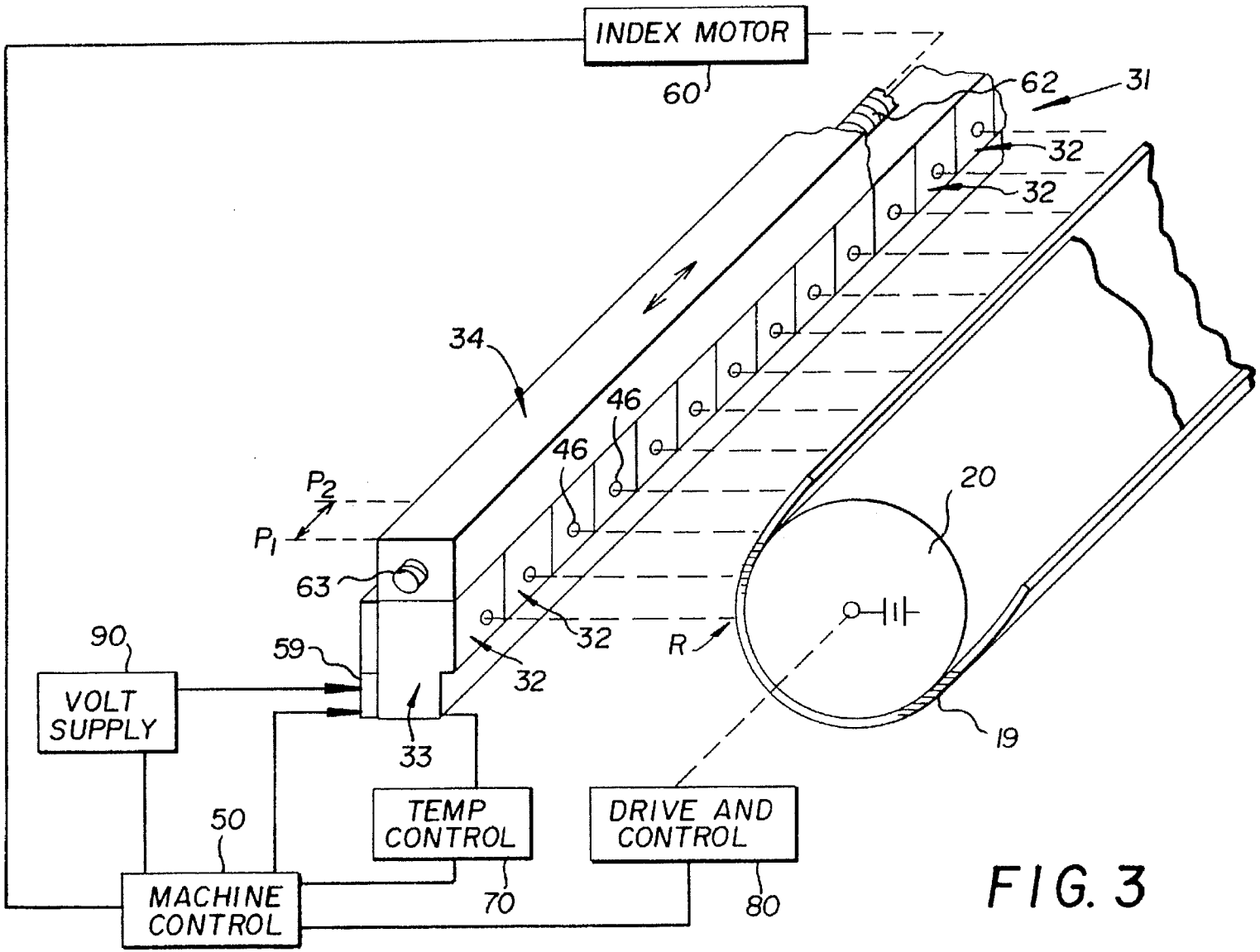
FIG. 3 is an enlarged schematic perspective view of one of the transfer assist assemblers shown in FIG. 1.

As shown in FIG. 3 the entire array 31 of drop generators 3 is coupled to indexing assembly 34, which can comprise, e.g. a helical drive screw 62, driven by index motor 60 to translate the array via threaded bore 63. The indexing translation is in a direction parallel to the axis of rotation of back up roller 20 so that the orifices 46 of the drop generators can address different transverse positions across the drop application region R.

Figure 5:
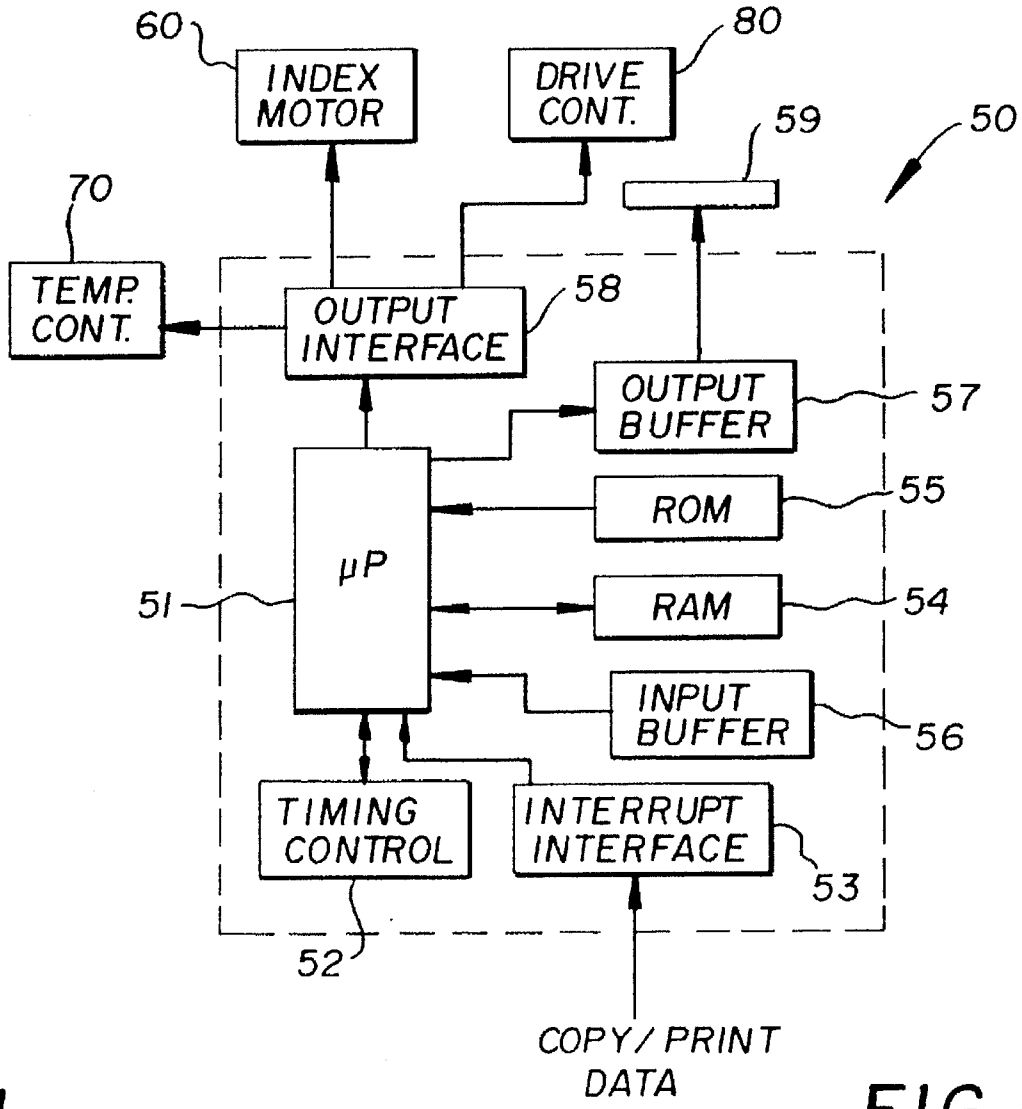
FIG. 5 is a block diagram indicating a control system for employing the transfer assist system of the present invention in electrostatographic apparatus.

Referring to FIG. 5, the machine control 30 of the electrophotographic apparatus can be a microprocessor control system that controls the overall operation of the copying device, in addition to those aspects relating to transfer assist according to the present invention. The control 50 includes microprocessor 51, with its related timing control and interrupt interface sections 52, 53, and cooperative RAM and ROM memories 54, 55. The control system can also include input and output buffer memory sections 56, 57 and output interface 58 for directing control signals to subsystems such as index motor control 60, temperature control 70 and drive control 80.

The functioning and construction of the transfer assistance system and process of the present invention will be further appreciated by considering one mode of operation. Thus, the electrophotographic apparatus operates under the control of instructions in ROM 55 to form an electrostatic image and develop it with charged toner particles. At this stage the microprocessor 50 has received input data about the nature of the copy sheet and/or the nature of the toner image on the copy sheet. For example, the input information can comprise copy sheet size signals, copy sheet position signals, copy sheet orientation signals (i.e. landscape or portrait), copy sheet composition signals (plain paper, coated paper, transparency, etc) or copy sheet weight signals, which can be produced in response to operator selections. When the toner image is based on electronic digital data, the input information can comprise detail (e.g. bit-map) information about the toner image, including for example, its alpha numeric composition, its margins, its solid area content, its half-tone content, its continuous tone content, its line content and its different color toners contents. In optical copiers, photoelectric or electrostatic detectors can sense developed toner or latent electrostatic images to provide similar input information about image contents to the machine control 50 via interrupt interface 53. Such input information is processed by the microprocessor 51 according to routines from ROM 55 and data for controlling the application of release liquid is devised and stored in RAM 54, to be output to output buffer 57 and/or shift register 59, in timed relation with the passage of the intermediate transfer member 19 through application region R.

In response to control signals from machine control 50, the drop generators 32 of array 31 are selectively operated to direct line by line drop patterns of released liquid onto the respective linear sections of the surface of intermediate transfer member 19 that sequentially pass application region R on their way to contacting and joining with the toner image photoconductor 11 at the transfer region 15. The movement of the surface of member 19 is controlled by its drive control 80, as coordinated by machine control 50, to be in a proper timed relation with drop generator actuations.

In the preferred embodiment shown in FIG. 3, the drop generator array 31 is indexed laterally to increase resolution of the offset inhibiting drop pattern that is applied. The drop generator actuating signals can be scheduled to shift register 59 to effect the desired drop pattern in proper preceding timed relations to the respective portions of a copy sheet with which they are intended to interface. For example, if the input signals indicates an alpha numeric text sheet having margins, the output data to shift register 59 can comprise fire/no signals that will cause the drop generators to apply release liquid only to the area of the transfer member 19 that will contact the copy sheet area within the margins. Similarly application patterns can be signaled to correspond to only the line portions of text on a copy sheet or to correspond in a particular fashion to a full page continuous or halftone, black and white color imagae. Additionally, the machine control can effect application of different quantities of liquid to different sheet regions.

With the release liquid pattern interposed in proper register to join the surface of the intermediate transfer member and the toner particle layer or layers (comprising the toner image that was transferred from the photoconductor 11 to the intermediate transfer member 19), the member 19 moves forward along its path to the secondary transfer region formed by the nip of heated roller 21 and pressure roller 22. At this stage the release liquid pattern between the toner and surface of transfer member 19, assists in effecting a complete transfer of toner to the copy sheet C because of the selected physical characteristics of the release liquid.

More particularly it is an important feature of the present invention that the release liquid, in addition to being suitable for jetting to form predetermined patterns on the photoconductor and/or transfer member surface, have a low integral cohesive strength or form a low strength bond interface with the transfer element surface or toner stack. One particularly preferred release liquid pattern comprises a thin wax layer pattern (e.g. having a thickness in the range of about 0.1 to 20 microns). Wax materials for use as release liquids in practice of the invention preferably exhibit a melting point above normal ambient temperatures, e.g. greater than about 60° C., and have useful jetting viscosities (e.g. less than about 15 centipoise) and surface tensions (e.g. less than about 35 dynes per square centimeter) at print heat temperatures of greater than about 80° C. Particular material from which release liquids can be selected based on these guidelines comprise $C_{18}$ stearic acid homologues (stearic, behenic, palmitic, myristic), $C_{18}$ alcohols and homologs (including alpha-omega diols), $C_{18}$ amides and homologs, polyethylenes (of molecular weight less than 1000), Carnauba wax, Candalilla wax, Beeswax, Monton wax (Hoechst Wax 5), Jojoba wax, and n-paraffin or isoparaffin ($C_{23}$–$C_{32}$) waxes.

One desirable system for practice of the present invention provides for the wax material to be heated to a melted state in a supply region and have sufficiently low viscosity to be transported by moderate pressure to the liquid manifold 33, where it is heated to a regulated temperature providing a desired viscosity and surface tension for jetting (e.g. about 100° C.). Upon contacting the transfer element the release liquid can again change phase to a solid, or become a gel, prior to interfacing with transferred toner stacks. In certain instances it can be desirable for the jetted drops to spread and enlarge their pattern, or to merge and form continuous areas that comprise a thin wax layer. After coupling with a transferred toner image, the release material layer can assist transfer by splitting within its own strata, so that a segment of the layer transfers with the toner. Or, the release layer can separate from the transfer member completely with the toner layers. Such modes can be further facilitated by providing transfer element surfaces or coatings having a uniform low surface energy. In such modes, the release material can provide a cover over the toner image on the copy sheet to protect it, or provide a desired surface gloss characteristic. Alternatively, the release layer can separate entirely from the toner stack and remain on the transfer surface, or be removed therefrom at a subsequent station. In any event, the present invention provides that the split at transfer does not occur within the toner stack, and therefore provides a highly desirable transfer efficiency.

Useful release oil coverages can vary in the range from about 0.1 to about 10 milligrams per square foot. Useful drop volumes can be in the range from about 30 to about 150 picoliters and typical drop emission rates can be in the range of about 5 to about 50 kilohertz. Spacings from the drop generator array to the photoconductor or intermediate transfer member can be in the order of about 0.2 to 2.0 centimeters and drop speeds can be from about 5 to 15 meters per second.

Referring again to FIG. 1, in some preferred embodiments it can be desirable to incorporate a transfer assist assembly, such as illustrated by 130, at a location along the imaging member's (e.g. photoconductor 11) path of travel, prior. to development with toner particles at station 14. In such embodiments, the construction and functioning of assembly 130 can be as described with regard to assembly 30, so as to controllably direct drops of toner release liquid toward predetermined portions of the photoconductor as they pass an application region R', and therefore underlie toner applied onto the photoconductor's latent electrostatic image. The patterns of the release liquid applied to the photoconductor can have the same predetermined correspondences to particular image types and contents as described above regarding assembly 30; and the assembly 130 can function independently of an assembly such as 30, or of an intermediate transfer member, to assist transfer of toner from the photoconductor. Of course, the image member transfer assist assembly 130 can function in combination with the intermediate member transfer assist assembly, (e.g., shown in FIG. 1)

Figure 2:
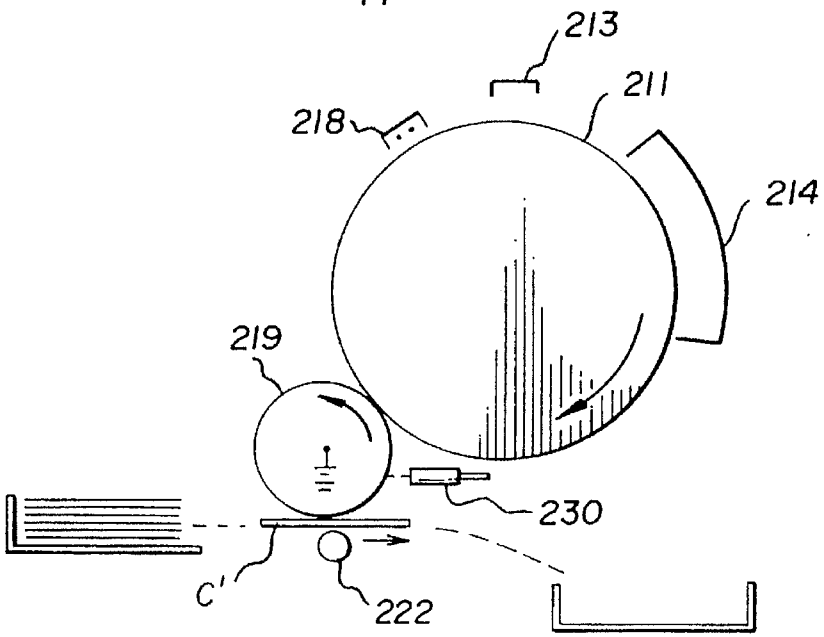

FIG. 2 illustrates another alternative embodiment wherein the image member 211 comprises a dielectric covered drum and the latent electrostatic image is formed by an array 213 of stylus discharge devices. The toner image is developed onto the electrostatic image by cascade development station 214 and transferred to intermediate transfer roller 219, thence to copy sheet $C^1$ at the heated nip with pressure roller 222, while the surface of member 211 is regenerated, e.g., by grid controlled discharger 218. The transfer assist assembly 230 functions in the same manner described with respect to assembly 30 and can be constructed in accord with one of the various constructional embodiments the invention set forth above.

The invention has been described with reference to preferred embodiments, but it will be understood that variations and modifications can be effected within the spirit and scope of the invention.

We claim:

1. In electrostatographic apparatus having means for forming an electrostatic image on a support member, means for applying charged toner particles to form a toner image on said support member and means for transferring such toner image to a copy sheet, a system for assisting toner image transfer comprising:

(a) drop generator means for controllably directing a plurality of drops of release liquid to form a release pattern for joining with such toner image; and (b) supply means for delivering such release liquid to said drop generator means.

2. The invention defined in claim 1 wherein said drop generator means is located to direct drops of release liquid onto said support member prior to its development with toner particles.

3. The invention defined in claim 1 wherein said apparatus comprises an intermediate transfer member for receiving the transfer of such toner image from said support member and re-transferring such toner image to a copy sheet and wherein said drop generator means is located to direct drops of release liquid onto said intermediate transfer member prior to its receipt of such toner image.

4. The invention defined in claim 1 further comprising control means for controlling said drop generator means to form a release liquid pattern corresponding in the size to a related image.

5. The invention in claim 1 further comprising control means for controlling said drop generator means to form a release liquid pattern corresponding to the image content of a related toner image.

6. In electrophotographic apparatus having a photoconductor member movable along an operative path past a charging station, an exposure station and development station that cooperate to form a toner particle image, a toner transfer assistance system comprising:

(a) drop generator means for controllably directing drops of toner release liquid toward predetermined locations of a region located along said operative path, upstream of said development station;

(b) supply means for delivering release liquid to said drop generator means; and (c) means for controlling said drop generator means in timed relation with movement of said photoconductor member to form a predetermined pattern of release liquid on said photoconductor member.

7. The invention defined in claim 6 wherein said drop generator comprises a piezoelectric drop-on-demand device.

8. An electrostatographic apparatus comprising:

(a) a charge retentive image member movable along an imaging path;

(b) means for forming an electrostatic image on said image member;

(c) means for developing said image member with toner particles to form a toner image;

(d) an intermediate transfer member movable along a transfer path between said imaging member and a copy sheet feed path;

(e) means for effecting transfer of toner images to said transfer member from said image member and from said transfer member to a copy sheet; and (f) first transfer assist means for selectively directing a plurality of drops of release liquid onto said transfer member, at a location along said transfer path upstream from the site of toner image transfer, to form a predetermined release liquid pattern beneath toner images.

9. The invention defined in claim 8 further comprising second transfer assist means for directing a plurality of drops of release liquid onto said image member in a predetermined pattern at a location lapstream of said developing means.

10. The invention defined in claim 9 wherein said second transfer assist means comprises a drop-on-demand device.

11. The invention defined in claim 8 wherein said first transfer assist means comprises a drop-on-demand device.

12. The invention defined in claim 8 wherein said first transfer assist means comprises an array of piezoelectric, drop-on-demand devices.

13. The invention defined in claim 8 wherein said apparatus comprises means for storing data representative of bit map content of toner images and means for controlling said transfer assist means to form release liquid patterns corresponding to such data.

14. In a process of producing electrostatographic copies that includes forming a toner image that is electrostatically attracted to a support member and transferring such toner image to a copy sheet, the improvement wherein said step of transferring such toner image comprises forming, on the support, a pattern of release liquid drops that is predeterminedly adapted to such toner image.

15. The process of claim 14 wherein said pattern forming step includes selectively directing drops of release liquid toward such support.

16. The process of claim 14 wherein said pattern forming step includes moving such support past a drop impact region and controlling a plurality of drop-on-demand generators directed toward said impact region.

17. The process of claim 16 further comprising the steps of storing bit map data representative of toner images and controlling drop generators in accord with such data.

18. The invention defined in claim 14 wherein said release liquid comprises a wax material.

19. The invention defined in claim 18 wherein said wax material has a melting point above 60° C.

20. The invention defined in claim 18 wherein said wax material has viscosity less than about 15 centipose and surface tension less than about 35 dynes per square centimeter at temperatures above about 80° C.

* * * * *

UNITED STATES PATENT AND TRADEMARK OFFICE

CERTIFICATE OF CORRECTION

PATENT NO. : 5,627,632
DATED : May 6, 1997
INVENTOR(S) : William J. Staudenmayer et al

It is certified that an error appears in the above-identified patent and that said Letters Patent is hereby corrected as shown below:

Col 8, line 13, "lapstream" should read --upstream--

Signed and Sealed this

Twenty-first Day of October 1997

*Attest:*

*Attesting Officer*

BRUCE LEHMAN

*Commissioner of Patents and Trademarks*